US005425402A

United States Patent [19]

Pringle

[11] Patent Number: 5,425,402

[45] **Date of Patent: * Jun. 20, 1995**

[54] BOTTLING SYSTEM WITH MASS FILLING AND CAPPING ARRAYS

[75] Inventor: Frank G. Pringle, Medford, N.J.

[73] Assignee: Mass Filling Systems, Inc., Medford, N.J.

[ * ] Notice: The portion of the term of this patent subsequent to Apr. 26, 2011 has been disclaimed.

[21] Appl. No.: 233,366

[22] Filed: Apr. 25, 1994

Related U.S. Application Data

[63] Continuation-in-part of Ser. No. 963,596, Oct. 20, 1992, Pat. No. 5,305,809.

[51] Int. Cl.[6] ..... B65B 1/04; B65B 3/04; B65B 37/00

[52] U.S. Cl. ..... 141/235; 141/237; 141/177; 141/84; 141/157; 414/796.2; 53/97; 53/101

[58] Field of Search ..... 53/89, 90, 94, 97, 101; 141/84, 177, 235, 156, 157, 159, 163, 168, 169, 170, 181, 237, 242, 243; 414/796.2, 796.3, 796.4, 796.8

[56] References Cited

U.S. PATENT DOCUMENTS

| | | | |
|---|---|---|---|
| 518,306 | 4/1894 | Clark | 141/237 |
| 662,087 | 11/1900 | Nichols et al. | 141/235 |
| 2,075,054 | 3/1937 | Podel | 53/89 |
| 3,020,939 | 2/1962 | Donofrio | 141/169 |
| 3,270,783 | 9/1966 | Hughes | 141/1 |
| 3,332,788 | 7/1987 | Barnby | 53/89 |
| 3,612,299 | 10/1971 | Shaw | 214/6 N |
| 3,651,836 | 3/1972 | Johnson | 141/103 |
| 3,888,364 | 6/1975 | Inoue et al. | 214/8.5 A |
| 3,937,336 | 2/1976 | Carlson | 214/6 P |
| 4,055,202 | 10/1977 | Greene | 141/59 |
| 4,073,322 | 2/1978 | Bennett | 141/169 |
| 4,270,584 | 6/1981 | Van Lieshout | 141/11 |
| 4,313,476 | 2/1982 | Bennett et al. | 141/59 |
| 4,411,295 | 10/1983 | Nutter | 141/59 |
| 4,493,349 | 1/1985 | Pomponio, Sr. | 141/59 |
| 4,603,896 | 8/1986 | Vasseur et al. | 294/2 |
| 4,621,969 | 11/1986 | Berghäll et al. | 414/331 |
| 5,159,960 | 11/1992 | Pringle | 141/1 |
| 5,168,905 | 12/1992 | Phallen | 141/1 |
| 5,305,809 | 4/1994 | Pringle | 141/84 |

*Primary Examiner*—Henry J. Recla
*Assistant Examiner*—Steven O. Douglas
*Attorney, Agent, or Firm*—Eckert Seamans Cherin & Mellott

[57] ABSTRACT

Two or more of a bottle-cleaning operation, a bottle-filling operation, a cap-dispensing operation, and a cap-affixing operation simultaneously process arrays of equally sized containers in an x-y array by engaging the bottles with movable heads of a head-carrying assembly. The containers can be a compressed array of bottles or a case of bottles in a box or the like. The nozzles for the cleaning and filling operations, and cap-handling devices for the dispensing and affixing operations can be repositioned for change to a new container size, for example with motor driven positioners. At least a subset of the heads are displaced along the axes of the container array, into registry with bottle arrays of the different size bottles. Preferably, each operational system in sequence is independently controlled to effect a container size change, such that the production line can be changed to the new size as the leading edge of containers of the new size arrive at the respective operational system.

16 Claims, 7 Drawing Sheets

BOTTLING SYSTEM WITH MASS FILLING AND CAPPING ARRAYS

CROSS REFERENCE TO RELATED APPLICATION

This is a continuation-in-part of application Ser. No. 07/963,596, filed Oct. 20, 1992, now U.S. Pat. No, 5,305,809.

BACKGROUND OF THE INVENTION

1. Field of the Invention

The invention relates to means for filling and capping runs of containers having at least two different lateral widths, including a processing system that has container-engaging heads for filling and capping the containers while in a two dimensional regular array, and at least semiautomatic means that varies the spacing of the heads in two dimensions, for job changing from one container width to another. By repositioning the heads of successive machines along the processing line into registry with the two dimensional array and processing the array as a unit, line throughput is improved. The containers can be processed in this manner while remaining in a box or similar receptacle that maintains the position of the containers in a regular array. The successive machines can be changed over to die new head spacing as the leading edge of the new container size arrives.

2. Prior Art

Filling machines for containers such as beverage bottles and the like conventionally pass the containers in a single file along one or more conveying paths. The containers stand upright for filling via nozzles that direct fluid or other material contents downwardly into the containers. Filling with a fluid, whether to add ballast, to insert washing fluid or to fill containers with their final contents, takes a certain amount of time. Containers can be filled using heads that move in registry with continuously moving containers, or the containers can be stopped in registry with stationary-heads, and after a filling step indexed by one or more container positions, whereupon the filling step is repeated.

A rotary or carousel filling device for continuously moving containers is disclosed, for example, in U.S. Pat. No. 3,270,783—Hughes. Indexing devices with plural heads, that index by several containers at once, are disclosed in U.S. Pat. Nos. 3,020,939—Donofrio; 3,651,836—Johnson; and 4,073,322—Bennett. In U.S. Pat. No. 5,168,905—Phallen, the containers are indexed by a single container position, but each head adds only a fraction of the material needed to fill the containers fully.

It is also possible to fill a two dimensional array of containers as a unit, as disclosed in U.S. Pat. Nos. 5,159,960—Pringle or 4,055,202—Greene, or to fill one line of containers at a time, when held in a two dimensional array, as in U.S. Pat. No. 4,270,584—van Lieshout. The containers are positioned in registry with dispensing nozzles or "heads" mounted in a two dimensional array, coupled via valves to a controller that dispenses the fluid for a predetermined time or volume when the containers are in position.

Whether the dispensing heads, nozzles, capping devices or the like are in a circle, in a line or in a two dimensional array, tile heads must align in registry with the openings of their respective containers. The containers typically are conveyed while resting laterally against one another, and the container openings are centered and thereby regularly spaced. A substantial problem is encountered if a container processing line is to handle containers of different lateral widths, because the center-to-center spacing of the filling, capping and similar head devices must be reset.

In a serial processing line having one or more rows of containers proceeding along a path, the sidewalls or rails of a conveyor, slide track or similar arrangement guide the containers along the conveyor and prevent the containers from being displaced laterally of the direction of advance along the container stream. The sidewalls, rails or the like keep the centerlines of the containers along the centerline of the row of nozzles. It is known to provide rails to engage the containers at a flange at the neck of the container. Typically, however, the sidewalls of the containers rest along the conveyor sidewalls, guide rails or the like. During job changes from one width of container to another, the conveyor sidewalls or rails on both sides are adjusted laterally inwardly or outwardly of the conveyor centerline.

Alternatively, the filling or capping devices can have container-carrying pocket structures, the pockets being of different sizes for different container sizes, but in each case arranging the containers at a fixed spacing to align the containers to nozzles, cappers or the like that are not adjustable in spacing. In that case, the pocket structures must be changed for a job change. Additionally, there is an inherent waste of space because the nozzles or cappers must then be spaced to accommodate, the largest size of container that the line will ever run.

A filling machine or the like could also have heads arranged for the smallest containers arranged in the most densely packed possible array. Only use those nozzles which happen to align with the openings of larger containers could be used (i.e., opened and closed via individually controlled valves). For example, the nozzles can be biased closed and caused to discharge due to contact a container. Such an arrangement, although possible with careful planning, would not be efficient. For example for center-opening regular containers, the different possible sizes of the containers would need to be odd multiples of the smallest container diameter (e.g., one, three or five units of diameter), such that the centers of an array of smaller containers would align with the centers of a larger container array. This solution to the problem is cumbersome, as well as expensive because many of the nozzles routinely would go unused (e.g., eight of nine unused when processing a three diameter unit container.

Inasmuch as job changing a container line can involve quite a lot of work, it is most typical for a bottling plant or the like to run a single size of container exclusively, or perhaps to run a single size for a very long time before making a job change, and thereby build up a sufficient inventory to meet the demand between relatively infrequent job changes. It is also typical for container sizes to be standardized so that the same equipment can handle different products or brands.

It is desirable for products such as beverages or the like, that the containers for different products be distinct as to shape, color, markings and the like. It would also be desirable to permit different container sizes, but job changing and equipment compatibility constraints are such that all containers for a given product type are generally very similar in size. For example, soft drink, beer and liquor containers are typically of the same standardized lateral dimensions and have necks of a standard size, axially centered on the container and placed at a standard Might. It would be advantageous to provide convenient means for a container processing line to run containers of different sizes; such as different lateral widths and/or different eights, particularly for specialty products.

It is known to vary the center-to-center spacing of nozzles of a filling machine to permit a change between container sizes. For example, in U.S. Pat. No. 5,168,905—Phallen, fill nozzles are mounted along a rail parallel to the path of containers along a bottling line, each of the nozzles being movable along the rail to a selected position at which it can be fixed using a clamp such as a set screw arrangement. Such a mounting requires the individual placement and fixing of each of the nozzles. It may be possible to speed the process by inserting a length reference tool applicable to the respective container size between the nozzles to set their spacing. Nevertheless, each of the nozzles must be separately fixed in place, and an endmost or starting nozzle in the line must be positioned at a position corresponding to the position of one of the containers along the line, e.g., a container held stationary via a stop.

According to U.S. Pat. No. 662,087—Nichols et al., the center-to-center spacing of a series of nozzles in a line is adjustable commonly. The nozzles are attached at the junctions of a "lazy tongs" mounting having pivotally connected structural members that can incline to shorten the spacing or extend to lengthen the spacing, within limits defined by the width of the connected structural members. An endmost one of the members is attached to a manual positioning apparatus such as a slide bar having spaced holes for receiving a locking pin that fixes the lazy tongs at one of a number of predetermined reference positions corresponding to container widths.

Adjustable positioning apparatus for nozzles and the like can be provided in a two dimensional array, for gang filling as in copending application Ser. No. 07/963,596, filed Oct. 20, 1992, which is hereby incorporated. In that application, and in U.S. Pat. No. 5,159,960, which is also incorporated, containers are filled while held in an X-Y array, each container in the array being held at a predetermined position in a regular array, and filled simultaneously. In the '596 application, the containers are engaged by a movable member that urges regularly shaped containers laterally inward of the array, causing them to assume defined positions. It can speed the filling of containers if an entire X-Y array of containers is filled simultaneously, as opposed to filling them serially.

However, there are problems in adapting gang filling procedures to high speed or continuous operation, particularly if job changes are provided for, because of problems in ensuring that the containers form a full array with each container in registry with the nozzles of the filler. In the '960 patent, the containers are filled with a limited amount of water ballast immediately after being depalletized, and normally remain substantially in position in the array between depalletizing and ballast injection. And in any event, if some of the ballast misses a container or if a position in the array is not occupied, there is little waste or damage. In the '596 application, the containers are positively-arrayed by the sweep device, and movable valves for dispensing contents into the container are only opened if a container engages a nozzle.

Gang falling according to the prior art generally tends to be a batch operation rather than a continuously progressing operation, even where a plurality of containers are filled at once during particular process steps. Examples of gang filling an array of containers are disclosed in U.S. Pat. Nos. 4,055,202—Greene; 4,270,584—van Lieshout; and 4,411,295—Nutter. In each case a regular X-Y array of containers is provided that corresponds at least along a line to an array of nozzles or fill heads. In Greene the containers are bottles; in van Lieshout they are open top cups for beer; and in Nutter the containers are 55 gallon drums having off-center fill holes coupleable to fill head via flexible hoses.

In order to maintain array positions, Greene holds the bottles in a box-like receptacle in which the bottles fit closely so as to occupy regular positions, provided the receptacle box is full. If the receptacle box is not full, the container positions are uncertain because the abutment of the containers is relied upon to position them at regular positions in an array. A similar situation could be obtained by defining smaller receptacles for the containers, e.g., by webbing forming crossing walls between outer walls, in a manner similar to the container pockets of a linear conveyor. For loading containers into a two dimensional array of pockets, the containers must be moved axially over the walls or webbing defining the pockets, potentially by a manual operation. In van Lieshout, beer cups are placed manually into a box nearby one another but spaced somewhat. The open tops of the cups provide a wide enough target for the nozzles that spacing is not critical, provided the cups are substantially regularly spaced, i.e., by a manual operation. In van Lieshout, one row is filled at a time. In Nutter, not only must the 55 gallon drums be in correct position, but additionally their fill openings must be turned to toward one another in groups of four, for aligning with a fill head having four discharge fittings. Manual attention to positioning is required.

A gang filling machine is needed that more efficiently solves the problems of providing a regular array of containers corresponding to a regular array of nozzles, and that can be quickly, conveniently and efficiently set up to run containers of varying sizes. Furthermore, it would be most advantageous to apply gang processing concepts to additional container processing steps associated with a container filling plant, such as cleaning, capping and the like. It would be even more advantageous if at least some of the steps associated with transporting the containers through the processing steps could accomplished by "gang" transport, especially by processing containers through steps that do not require that the containers be removed from the box or crate in which the containers will ultimately be shipped.

SUMMARY OF THE INVENTION

It is an object of the invention to facilitate gang processing of bottles in a bottle processing plant having a number of production steps that are sensitive to the position of the bottles in an array.

It is another object to provide a container processing apparatus that handles varying sizes of bottles in bulk, with minimal operations needed to effect a job change from one container size to another, at any particular point along the process.

It is a further object of the invention to enable cost justified runs of small numbers of bottles through all phases of container processing, including bottles in non-standard sizes and bottles having off-center openings for filling and capping.

It is still another object of the invention to provide a means for automatically repositioning the heads of an X-Y array of container-engaging means such as cleaners, fill nozzles, cappers and the like, using actuators that are independently controllable and/or controllable in ranks, for positioning the heads in registry with container openings of various sizes to be filled.

These and other objects are accomplished by a bottling system for processing arrays of equally sized bottles through a given operation. The operation can be any of a bottle-cleaning operation, a bottle-filling operation, a cap-dispensing operation, and a cap-affixing operation. The bottling system is adjustable to process at least two different sized bottles.

More specifically, the bottling system has a flight conveyor defining a longitudinal axis (or an x-direction) corresponding to a direction of conveyance, and a lateral axis perpendicular thereto (corresponding to a y-direction) and in a common horizontal plane. The bottles or other containers of each of the different sizes are arranged in x-y arrays with other containers of the same size, such that the bottles have centers defining a regular, orderly array conforming to a pattern, such as either a quincunx array or a regular-matrix array. In a quincunx array, four bottles are positioned at the corners of a square and a fifth bottle is positioned in the center therebetween. In a regular-matrix array, four bottles are positioned at the four corners of the square or rectangle, while no bottle is positioned therebetween. While arranged in regular arrays, the centers of the bottles coincide with intersections between a plurality of parallel longitudinal axes and a plurality of parallel lateral axes. For purposes of convenience, the invention is described with reference to bottles as the containers. However, containers other than bottles can be filled and capped as well.

The bottling system comprises a flight conveyor, a support structure, and a plurality of heads carried by the support structure over the flight conveyor.

The flight conveyor supports a plurality of sets or arrays, each having a plurality of bottles or similar containers in an upright orientation. There are an equal number of bottles in each set of a given size. The bottles in each set occupy a plurality of container positions on at least two adjacent ones of the plurality of lateral axes. The centers of laterally adjacent bottles are evenly spaced apart. The sets of bottles can be packed in a packaging carton for each set. The flight conveyor can feed these packaging cartons one at a time in succession to the given operation for processing by that given operation.

The plurality of heads am movably mounted on the support structure for occupying head positions in registry with each, of the container positions of each set of bottles as the bottles are processed by the given operation, namely one of a container-cleaning system, a container-filling system associated with a source of material, a closure-dispensing system associated with a source of closures, and a closure-affixing system, to correspond to the associated given operation of the cleaning operation, the filling operation, the closure-dispensing operation, and the closure-affixing operation, respectively.

The support fixture for the supports is a drive system. This drive system is controllably operated to displace at least a subset of the heads along the longitudinal axes and another subset of the heads along the lateral axes perpendicular to the longitudinal axes, thereby being operative to alter the head positions for achieving at least two alternative spacings of the heads corresponding to the centers of the bottles of said at least two different sizes. This drive system preferably comprises a driven plain round shaft cooperating with linear drive nuts that are linearly displaced by rotation of the plain round shaft.

The bottles can be placed in a carton such that there are several rows of bottles in the y-direction and several columns of bottles in the x-direction to define a $m \times n$ matrix as seen in plan view. Thus, for example, three rows and four columns have twelve bottles constituting a set, and the set of twelve bottles can be disposed in a packaging carton that is the same size for each set in the container size of interest.

Some of the given operations require that the heads engage the open tops of the bottles. This can be accomplished by lifting the bottles to the heads, or by lowering the heads to the bottles. Accordingly, the support structure can further include a bottle elevator. The bottle elevator comprises a plurality of driven rollers defining the flight plane of the flight conveyor at the location of the given operation. Further, the elevator includes lifting panels disposed between the rollers to extend up between the rollers and lift a set of bottles up from the flight plane and into engagement with the heads.

Alternatively, the heads can include actuators for driving the lower ends of the heads down against the bottles. Where the given operation is the cleaning operation, the apparatus further comprises nozzles carried by the heads and a pressure source and a suction source coupled to the nozzles in the head. The pressure source and suction source are arranged for at least one of flushing the bottles for cleaning, and suctioning the bottles for removing foreign particles.

If the given operation is the filling operation, the apparatus further comprises nozzles carried by the heads, and a pressure source and a suction source coupled to the nozzles and the heads. The pressure source and the suction source are arranged for at least one of forcing material from the material source into the bottles and suctioning from the bottles air displace by the material discharged into the bottles. Preferably, the pressure source and suction source coact to force material from the material source into the bottles and suction from the containers air displaced by the material discharged into the bottles simultaneously. The cleaning and filling operations can be combined.

Means for repositioning the heads in the x-y array are preferably provided for each of a plurality of successive operations. For the cap-dispensing operation, the bottling system further comprises chute-carrying fixtures coupled to the heads for carrying chutes, inside of which a supply of caps can be transferred from a cap hopper to the bottle rims.

For the cap-affixing operation, the bottling system further comprises cap-accepting chucks carried by the heads and a mechanism for moving either the chucks or the bottles so that the chucks and bottles are in position for the chucks to affix the caps on the bottle rims.

Alternatively, the cap-dispensing operation and the cap-affixing operations can be combined in one station.

For this, the bottling system further comprises cap-accepting chucks coupled to the heads, a transfer plate for caps positionable in a first position between the chucks and the bottle rims and a second position permitting engagement between the chucks and the bottle rims. The transfer plate is supplied with caps in an x-y array by a dispensing system. The chucks and transfer plate are operated in coordination for transferring caps first from the carrier to the chucks, and then from the chucks to the bottles. Additionally, the chucks affix the caps thereto. The dispensing system can comprise a conventional cap hopper and cap chute system.

BRIEF DESCRIPTION OF THE DRAWINGS

There are shown in the drawings certain exemplary embodiments of the invention as presently preferred. The invention is not limited to the examples, which are presented to provide a better understanding of the invention as defined in the appended claims. In the drawings.

DETAILED DESCRIPTION OF THE PREFERRED EMBODIMENTS

Figure 1:
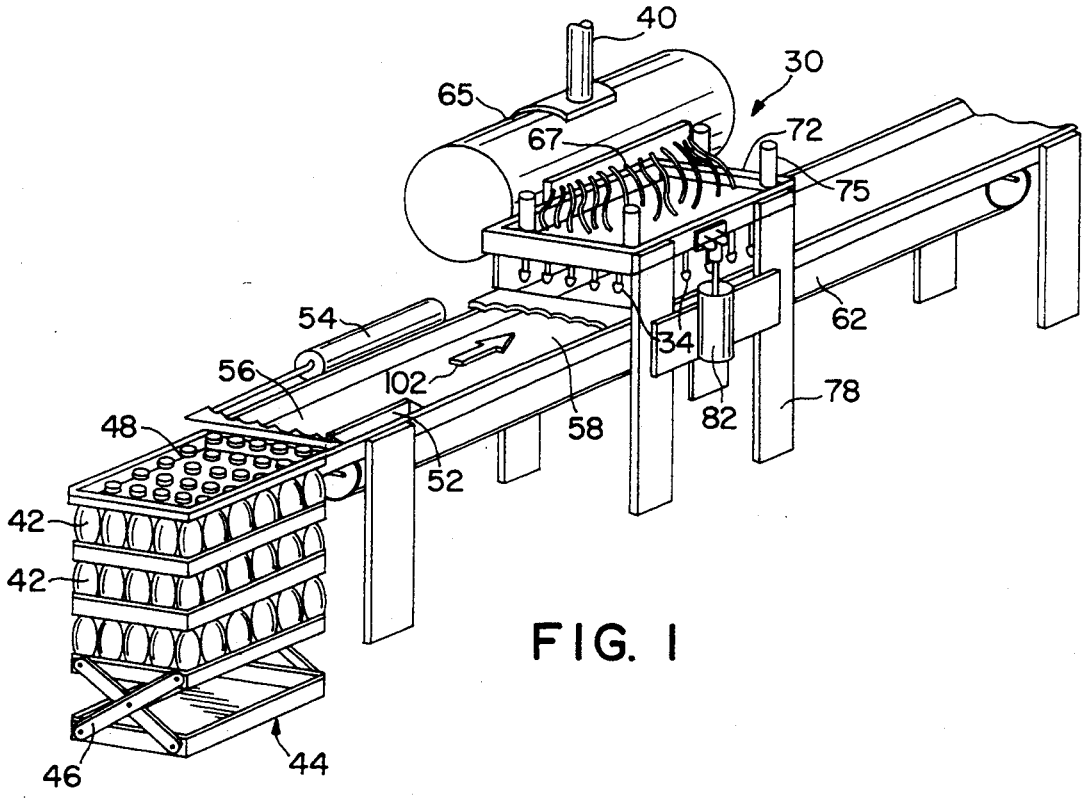
FIG. 1 is a schematic perspective view of a filling station of a bottling system with mass arrays according to the invention.

The invention seeks to improve bottling efficiency and throughput by advancing an array 20 of containers 22 though successive stations, where at each station all the containers 20 of that one array are simultaneously cleaned, simultaneously filled, or simultaneously capped, and so on. In FIG. 1, the bottling system with mass arrays comprises a filling station 30. The array is loaded and positioned automatically at the filling station 30 with the array being first packed or arranged such that each container 22 occupies one of the regularly spaced positions 32 in a regular array. The filling station 30 has nozzles 34 arranged in registry with the regular array, which are operated when the containers 22 are in place to discharge material from a source 40 to the containers.

In the embodiment shown the containers 22 are supplied from stacked ranks 42 of containers from a depalletizer 44, but the containers can also be supplied by other means, including being supplied in boxes as discussed below. Referring to FIG. 1, the depalletizer has a vertical displacement means 46 arranged to raise each rank 42 into a position 48 where the rank is encompassed by an extended sweep mechanism 52 driven by a pneumatic cylinder 54 or the like, for pulling the containers 22 onto the surface 56 of a conveyor 58. The conveyor has sufficient lateral dimension to accommodate the width of the X-Y-array 20 of containers 22 as they are moved to the filling station 30. The conveyor 58 may have an endless belt 62 for advancing the array under power of a motor (not shown) when pulled onto the conveyor surface 56 by the sweep 52 as shown. Alternatively the conveyor may be simply a sliding surface, in which case the sweep 52 must have a sufficient stroke length to move the array 20 into position at the filling station 30.

The array 20 of containers 22 need be of no particular length or width; however for purposes of efficiency it is desirable that a large number of containers be handled and filled at once. At the filling station 30, the conveyor or sliding surface 56 supports the containers 22 in an upright orientation with the containers occupying a plurality of evenly spaced container positions along at least one longitudinal axis of an array of the containers, and preferably along two mutually perpendicular axes. The array is preferably a reasonably large number of containers on a side, e.g., 12 to 24.

The containers 22 can be glass, plastic or the like. An advantageous container for use with the invention is a polyethylene terephthalate or PET container, which is light and durable, but which falls over easily, particularly at partial obstructions. By gang filling the containers 22 with at least a quantity of ballast, preferably soon after supplying the containers by depalletizer 44 or the like, the contents of the filled containers renders them much more stable and substantially solves any problems with containers falling over.

The plurality of nozzles 34 are relatively movable individually in directions parallel to the plane of the array 20, for setting the nozzles in registry with predetermined positions which the containers 22 occupy in a regular pattern, e.g., a packed array in which the containers abut one another with minimum spaces defined between them. After being positioned in this manner for a given size of container, the nozzles 34 are moved as a group vertically downward against the containers for filling, then upwardly away from the containers for clearance, as each successive rank or group of containers is brought into position, filled and then moved on down the conveyor for capping or the like.

The nozzles 34 are coupled to a source of material to be discharged into the containers 22, such as a tank 65 of liquid to which the nozzles 34 are connected by suitable flexible conduits 67. The flexible conduits 67 allow the nozzles 34 to be moved relative to their mounting structures and relative to the source. The source 65 can be faced in position or coupled to move vertically together with the positioned nozzles 34.

For vertically moving the nozzles, a supporting framework 72 for the nozzles 34 is mounted via vertical slide shafts 75 to fixed legs 78 or the like attached to the conveyor 58. A pneumatic cylinder 82 or similar drive means moves the framework upwardly or releases it for downward displacement by gravity, or alternatively, the pneumatic cylinder 82 can drive the framework 72 in both directions. When the framework 72 carries the nozzles 34 downwardly against the containers 22, the respective nozzles 34 open to discharge material from the source 65 into the containers 22.

Actuator means 90 are mounted on the fill station structure and arranged controllably to displace at least a subset of the nozzles 34 parallel to the longitudinal axis 102 of container advance along the conveyor, and preferably along both longitudinal and lateral axes. The actuator means 90 is thereby operable to alter the nozzle positions for achieving at least two alternative spacings of the nozzles 34, corresponding to evenly spaced container positions of containers of at least two different sizes.

The conveyor or other means for supporting the containers in an upright orientation arranges the containers 22 in an array wherein each container occupies one of a plurality of evenly spaced container positions in the X-Y array extending along the mutually perpendicular longitudinal and lateral axes of the array.

Figure 2:
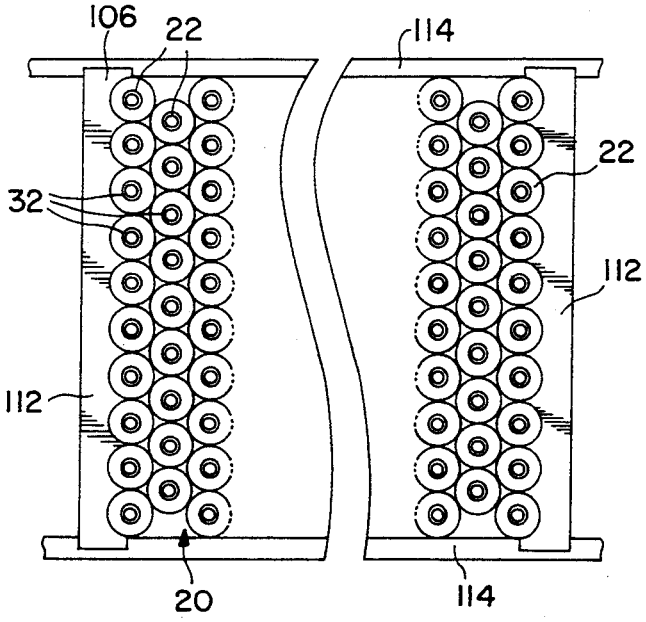
FIG. 2 is a plan view showing an X-Y array of containers engaged by a contoured bar for fixing their positions in the array.

Preferably, the containers 22 are arranged such that they directly abut one another in the array 20, as shown for example in FIG. 2. Where the containers are round as shown, the most packed form of array is such that the containers 22 in adjacent rows 104 (or columns 106) are staggered. It would also be possible to arrange the containers 22 in a precisely rectangular array of positions, for example if the containers are carried in a box, placed in receptacles on a movable platform, or otherwise bound in place. However by staggering every other row as shown, the containers 22 function to force one another into the regular positions. Lateral pressure exerted on the array 20 thus closely packs the array and causes each of the containers 22 to assume one of the regular positions even if isolated voids remain in the array, where no container is present.

For forcing the containers into the predetermined array, at least one laterally movable bar 112 is operable to urge the containers 22 laterally inwardly toward the center of the array 20. In FIG. 2, two opposed bars 112 are movable to exert inward pressure in a direction parallel to the direction 102 of advance of the array 20. The two remaining borders defining the periphery of the array are defined by fixed conveyor sidewalls 114. The movable bars 112 can be slidable via pneumatic cylinders (not shown) and/or pivotable relative to the containers 22 to permit the containers to pass. Alternatively, the bars 112 can advance from the sides of the conveyor, in which case additional movable bars are needed to engage the front and rear of the array in the direction of advance.

The movable bars 112 are contoured to complement a peripheral column or row 122 of the array 20 as packed. In FIG. 2, the left side of the drawing shows the packed array and the right side shows the condition of the array in the process of being packed. The bars 112 engage and position the first containers encountered as the bars 112 and the array 20 are relatively moved toward one another. These engaged containers are positively positioned due to the contour of bars 112, and thus define a contour for the packed positions of the next inward column or row. As the bars progressively constrict the array 20, each of the containers 22 is forced into one of the positions of the packed array. These positions are in registry with the nozzles 34 of the filling station 30.

This packing arrangement is substantially as defined in U.S. Pat. No. 5,267,590—Pringle, which is hereby incorporated. The contoured bars force the containers into one of the defined positions along both perpendicular axes, even if isolated voids remain in the array as a whole, where no container is present.

As the vertical drive means 82 raises and lowers the movable support framework 72 relative to the containers 22 (or perhaps raises and lowers the containers relative to the supporting structure), the nozzles 34 engage with the open tops 130 of the containers 22. The nozzles 34 each include an axially operated valve 135 that is spring biased to close and is opened by contact with a container 22. If a given nozzle 34 encounters a void instead of a container, its valve 135 remains closed.

Figure 3:
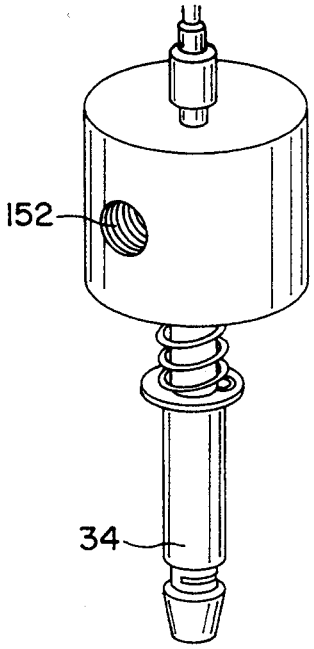
FIG. 3 is a perspective view showing an individual filling nozzle.
Figure 4:
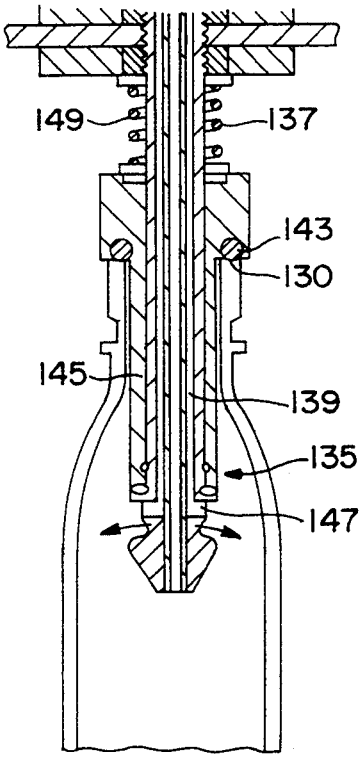
FIG. 4 is a longitudinal section view through the nozzle, taken along line 4—4 in FIG. 3.

An exemplary nozzle 34 is shown in FIG. 3 in perspective, and in FIG. 4 in cross section. The shaft 137 of the nozzle 34 is sufficiently narrow to fit within the open top 130 of the smallest container opening to be serviced by the filling machine. The valve 135 is opened by contact between the top edge of the container 22 and a radially protruding flange 143 that is large enough to encounter the edge of the largest container opening to be serviced.

One or more flowpaths are defined axially through the nozzle 34. In the embodiment shown, a first flowpath 139 is provided for discharging material from the source 65 into the container 22, and a second flowpath 14 1 is defined for applying suction to remove air that is displaced as the container 22 is filled. The second flowpath 141 can also be used to flush out the containers of dust or to suction out any particles therein.

The second flowpath 141 is not arranged to open and close, and preferably is coupled to a suitably controlled source of pressure or vacuum for moving air into or out of the container 22. The first flowpath 139, however, is opened when the top edge of the container 22 pushes the flange 143, and the movable sleeve 145 fixed thereto, upwardly on the shaft 137 of the nozzle 34 to uncover radial openings 147 leading from the first flowpath in the shaft, outwardly into the container 22. When no container is present, biasing spring 149 pushes sleeve 145 downwardly to cover openings 147.

In the embodiment shown in FIG. 4, the nozzles 34 include a guide bore 152 that receives a positioning shaft 160. There are a number of alternative ways to position the nozzles 34 in the X and Y directions parallel to the plane of the array. A threaded positioning shaft 160 can be provided for each nozzle 34, with the guide bore being threaded for receipt of the shaft and the shaft being rotated by a predetermined time or number of revolutions to achieve a correspond rag displacement. A reversible drive motor 162 can be provided, and operated by a computer or other controller which is programmed to move the nozzles between or among the required positions needed to run two or more different sizes of containers 22. In this manner the nozzle 22 can be moved forward and backward along the axis of the guide bore 152.

The actuator means 90 preferably comprises at least one drive such as a motor operable controllably to advance and retract the nozzles 34 along at least one of the X and Y axes. The motor can be a synchronous gear motor operated for a predetermined time to move a given distance, or a stepping motor, etc. It is also possible, for example if only two different container sizes are to be serviced, to use a solenoid drive for moving the nozzles 34 between two discrete positions, the spacing being defined by the stroke of the solenoid.

Figure 5:
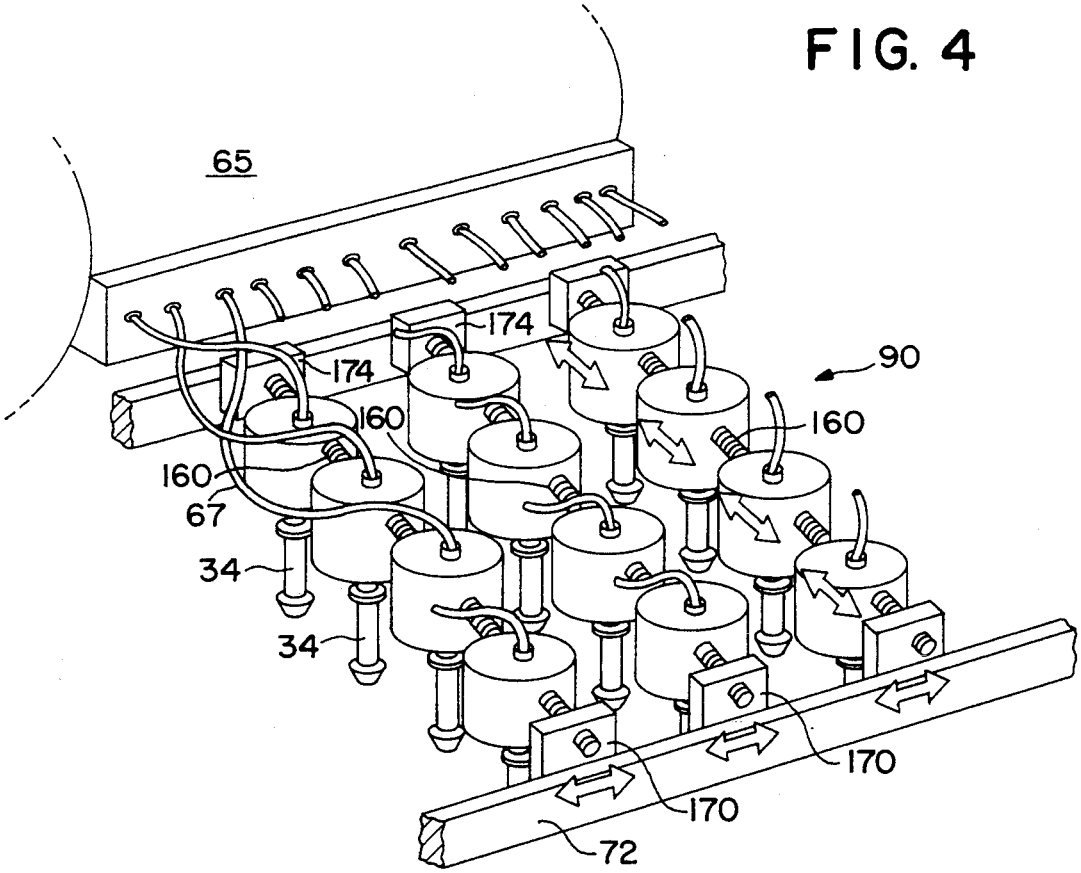
FIG. 5 is a schematic perspective view showing an X-Y nozzle positioning arrangement according to the invention.

It is possible to include a separate motor 162 for each of the two axes of movement of each nozzle 34. This may be expensive, and is not strictly necessary. Preferably a mechanical coupling is arranged such that the rotation of one motor for either or both of the X and Y axes is coupled to move all the nozzles 34 by the required amount. However, the different nozzles in the array must be moved by different distances in order to change from one container size to another. Referring to FIG. 5, all the nozzles in a given row or column can be carried on a support which has one motor or the like arranged to position the whole row or column. In FIG. 5, the nozzles 34 are carried on lateral support bars 170 arranged to set the position of a row of nozzles. At least one row/column motor 172 moves the support bar 170 back and forth along the walls of the framework for the nozzle support structure. The individual nozzle housings comprise means for varying the position of the respective nozzle 34 on its lateral support bar 170, such as a motor arranged to frictionally engage the bar.

One means for positioning the individual nozzle housings along the guide bar or shaft 170 using a single motor is to provide a disengageable screw thread coupling. According to this arrangement, each of the guide bars 170 can be threaded and arranged to rotate via a motor at an end block 174 (which can also contain a motor for moving the end block back and forth in a direction perpendicular to the axis of the guide bar 170). Via computer control of solenoids in the nozzle housings that either engage the thread of the guide bar 170 or release the guide bar, the individual nozzles on each bar are positioned. When a nozzle is to be moved, its solenoid engages the thread, whereupon rotation of the threaded guide bar moves the nozzle axially along the guide bar in one direction or the other. This can be done one nozzle at a time, e.g., such that when a next nozzle is to be moved the solenoid of the previous nozzle releases the thread and the previous nozzle remains in position notwithstanding rotation of the guide bar to move the next nozzle. Alternatively, all the nozzles can engage the thread of the-guide bar initially, and those having a shorter displacement simply disengage from the guide bar thread sooner. This arrangement is a combination of individual nozzle positioning and an arrangement wherein the nozzles rows and columns are advanced commonly by a motor drive or the like operating on all the nozzles in at least one of the rows and the columns.

Figure 6:
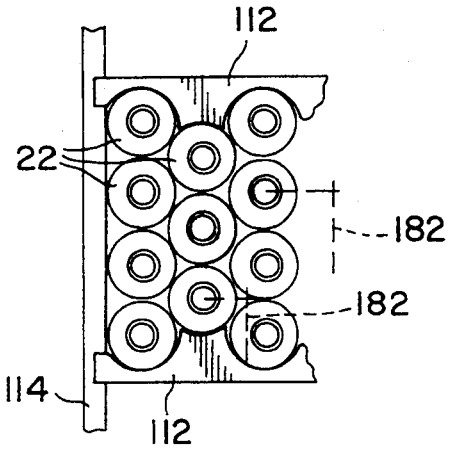
FIG. 6 is a plan view showing relatively smaller size containers arranged in a packed array.
Figure 7:
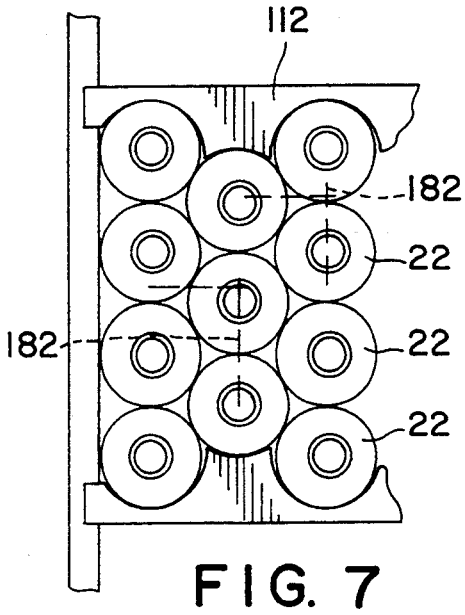
FIG. 7 is a plan view corresponding to FIG. 6 and showing relatively larger containers, the displacement of one of the nozzles between FIGS. 6 and 7 being shown in broken lines.

FIGS. 6 and 7 show the required container positions for containers 22 of different sizes. Using the same number of containers and nozzles, the array in FIG. 6 is smaller than that of FIG. 7. It is also possible to use different numbers of nozzles 22 (more for smaller containers) if the unused nozzles (when running larger containers) can be moved out of the way.

In the example shown in FIGS. 6 and 7, the necessary displacements for two of the nozzles between the arrays shown is illustrated by broken lines 182. It is apparent from lines 182 that the individual nozzles move different distances. In each case the contoured or scalloped side bars have urged the array into a packed arrangement. For a job change between container sizes, the nozzles are repositioned as shown and the contoured side bars 112 are replaced or selected for the new container size. A plurality of selectably movable sidebars 112 can be installed and selected under machine control, or a new side bar 112 can be put in place as a part of a job change.

Figure 8:
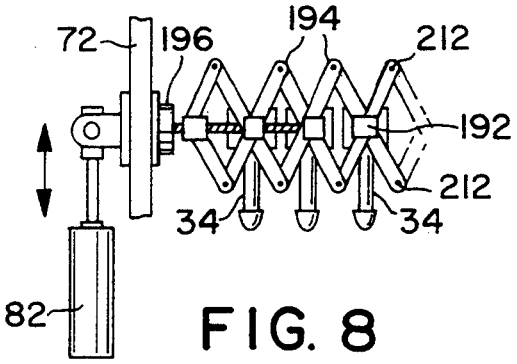
FIG. 8 is a partial side elevation showing a pantograph arrangement for positioning the nozzles along one of the axes.
Figure 9:
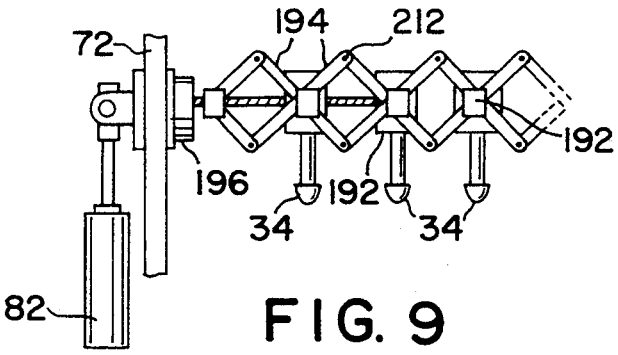
FIG. 9 is a view similar to FIG. 8 showing the pantograph in a relatively extended position.

FIGS. 8 and 9 represent another alternative for positioning a plurality of nozzles 34 using a single drive means. In this arrangement the nozzles 34 are carried at the junctions 192 of pantograph connecting arms 194, i.e., a structure of arms coupled to form parallelograms which can be opened or collapsed to vary the elongation of the structure. A motor 196 is operable to shorten or lengthen the distance between adjacent junctions 192 of the pantograph connecting arms 194, which are pivotally coupled at the junctions. Whereas all the connecting arms 194 are coupled together down the line, the pantograph spaces all the nozzles 34 by an equal amount, and thus moves each of the individual nozzles by a different distance than its neighbors, as needed to assume the new array. Once spaced, the vertical drive means 46 in FIG. 8 moves the positioned nozzles 34 into engagement with the containers 22. For changing between the container sizes of FIGS. 6 and 7, the pantograph arrangement is displaced approximately by the amounts shown in FIGS. 8 and 9.

Figure 10:
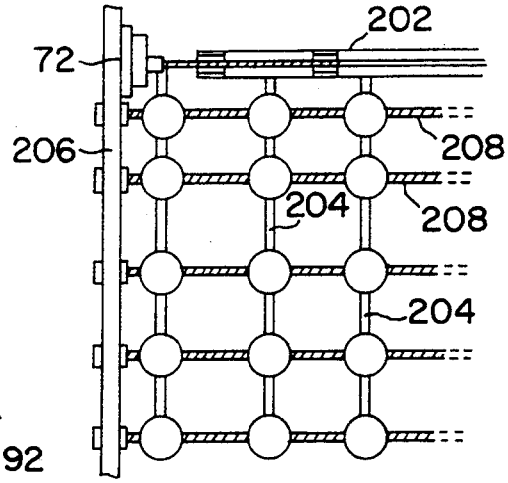
FIG. 10 is a plan view showing mutually perpendicular pantograph arrangements operable to position the nozzles by common displacement of rows and columns.

In FIG. 10, the pantograph arrangement is disclosed in an embodiment wherein both the row and column spacings are controlled by single motors or by gearing coupled to a single motor, whereby the overall array of nozzles can be enlarged and contracted. A column positioning pantograph 202 varies the spacing of guide bars 204 for the columns of nozzles 34, the guide bars passing slidably through the nozzle housings. A row positioning pantograph 206 varies the spacing of the nozzles 34 on the column guide bars 204, via row guide bars 208 that slidably pass through the nozzle housings at a position which does not interfere with the column guide bars.

The array of nozzles in FIG. 10 is not staggered. It is possible to arrange for staggered positioning of adjacent rows or columns to accommodate the type of array shown in FIGS. 6 and 7. For this purpose, every other guide bar can be carried on a central pantograph joints 192 and the others of the guide bars can be carried on the intermediate pantograph joints 212. The spacing between the intermediate pantograph joints 212 changes as the structure is elongated and contracted.

Therefore, in order to maintain a constant vertical position of all the nozzles 34 in the array, it is necessary to support the staggered nozzles (those on guide bars 212) vertically and to couple the nozzles to the intermediate pantograph joints 212 via a fitting that allows the joints 212 to slide vertically relative to the housing of the respective nozzle 34.

As shown in FIGS. 6 and 7, the columns of the packed array define straight lines of containers 22, but the rows are not straight. If it is necessary to use row guide bars 208 that are staggered and to use the intermediate pantograph joints 212 for X-Y positioning, the column guide bars 204 (which are straight) will provide the necessary vertical support to avoid a problem due to the slide fittings at the intermediate pantograph joints of the row guide bars 208. All the column guide bars 204 can be mounted at the centerline pantograph joints 192, which do not change in vertical position and thus maintain the vertical position of the nozzles 34.

Figure 11:
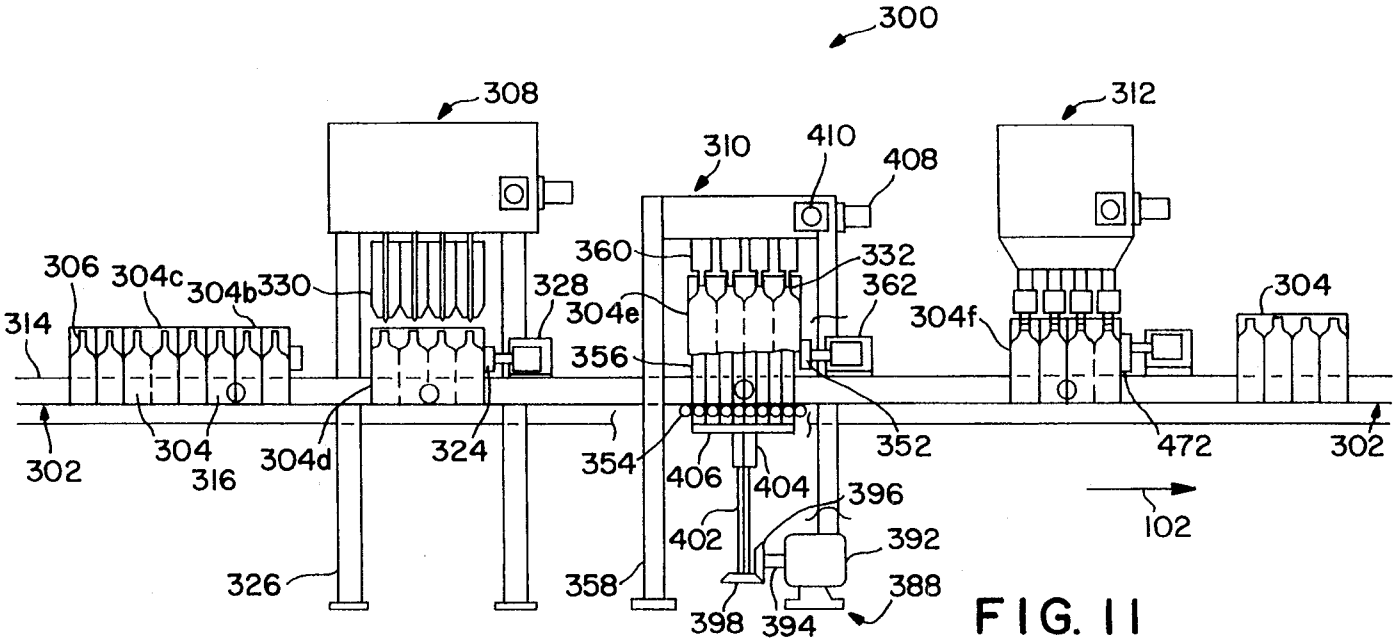
FIG. 11 is a schematic elevation view of a bottling system according to the invention, wherein a flight conveyor carries-cases of empty bottles successively through cleaning, filling, and capping operations.

In FIG. 11, a bottling system 300 according to the invention has a flight conveyor 302 carrying cases 304 of empty bottles 306 successively in-the direction of arrow 102 through cleaning, filling and capping operations at cleaning, filling, and capping stations 308, 310 and 312, respectively.

The flight conveyor 302 supplies cases 304 in a single lane between opposite flight bars 314 (one shown in FIG. 11) to a retractable case stop 316. Several or so cases 304 will queue up behind (i.e., in the direction opposite arrow 102) the retractable case stop 316 in abutting succession. Upstream (the direction opposite to arrow 102) from the case stop 316, the cases 304 are likely to have come off pallets via a depalletizer, and to have formed a single lane via a lane diverter, as is known in the art and not forming a part of the invention. The cases 304 behind the case stop 316 have their lids open and the bottles 306 in place with labels already affixed.

Figure 14:
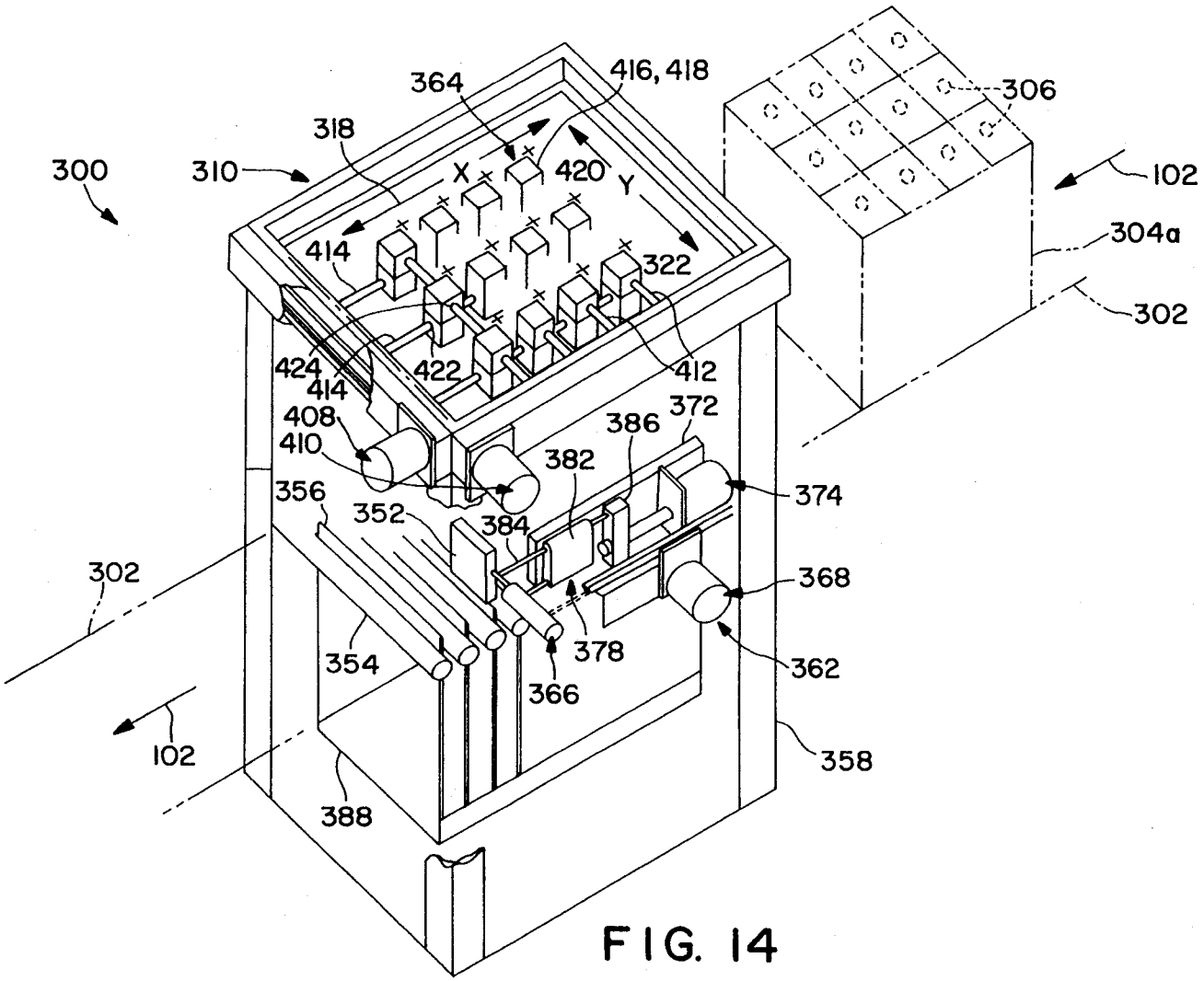
FIG. 14 is a perspective view of the station of FIG. 11 where the bottles are filled (except that certain motors are arranged differently), as viewed from the upper right of FIG. 11 and behind the plane thereof.

In FIG. 14, a representative case **304*a* is shown to carry twelve bottles 306 in a configuration of three columns by four rows. Each column extends parallel to an x-direction arrow 318 that is parallel to the flight direction arrow 102. Each row is parallel to a y-direction arrow 322 that is perpendicular to the flight direction arrow 102. This configuration defines a regular x-y matrix which, needless to say, differs from the quincunx arrangement of the containers 22 in FIGS. 1–10** (e.g., "quincunx" meaning four containers at the corners of a square and one container at the square's center).

In FIG. 11, the retractable case stop 316 operates intermittently. It retracts to release the one case **304*b* at the head of the queue, thus permitting the case 304*b* to advance down the flight conveyor 302. The case stop 316 soon operates again to stop the case 304*c* that immediately follows the just-released case 304*b*, thereby putting intervals between the cases as the cases proceed through the bottling system 300. The case 304*b*, once past the case stop 316, is permitted to proceed down the flight conveyor 302 to another retractable case stop 324 at the bottle cleaning station 308**.

Figure 15:
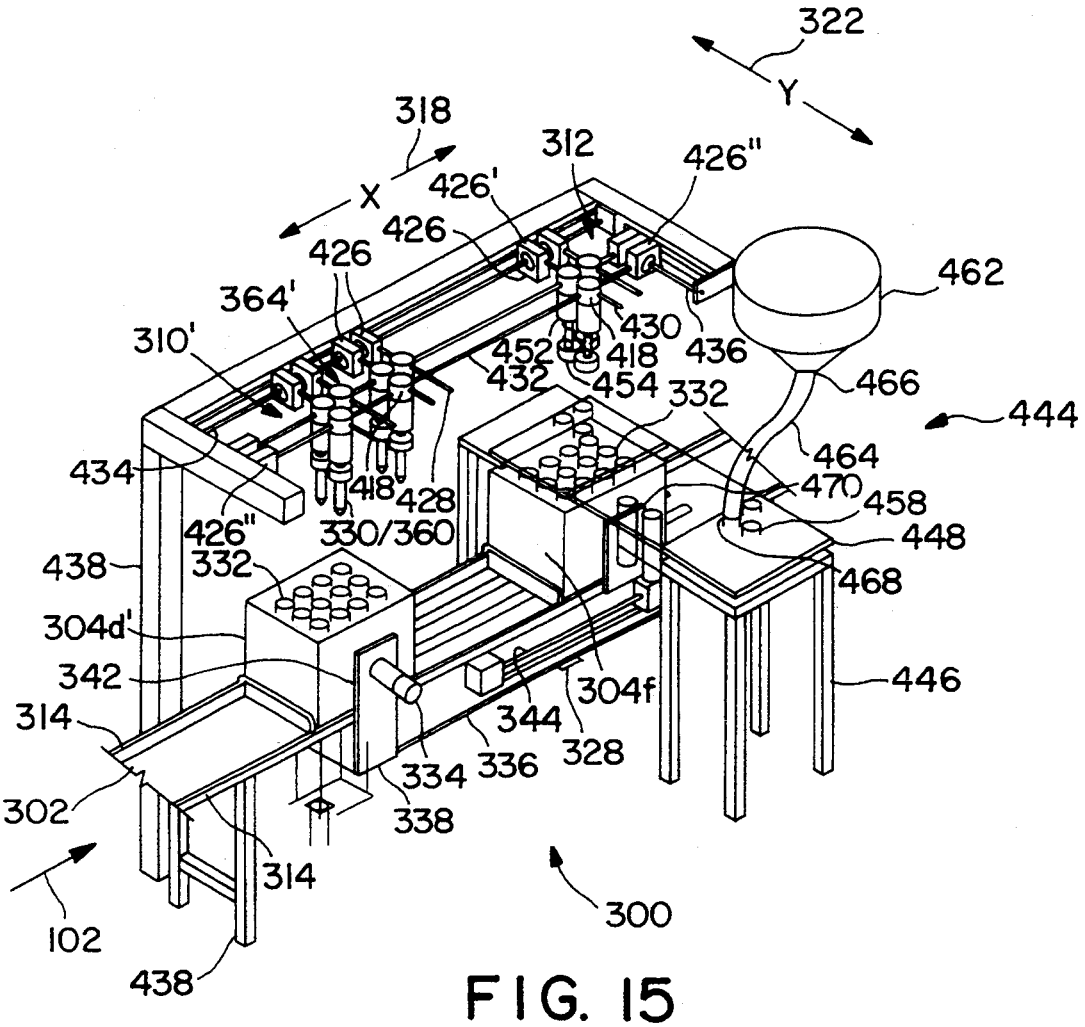
FIG. 15 is a schematic perspective view of another embodiment of the bottling system of FIG. 11, wherein this embodiment has two stations, one which combines the cleaning and filling operations and another which performs the capping operation.

The bottle cleaning station 308 has a support frame 326 that carries both a nozzle-carrying assembly (including nozzles 330) and a case positioning and tilting assembly 328 (see FIG. 15). In the embodiment shown, the nozzle-carrying assembly carries the same number of nozzles 330 as bottles 306 in the cases 304 (e.g., twelve). But the teachings of the invention apply equally as well to nozzle-carrying assemblies configured with a different number of nozzles than bottles in the cases. For example, the nozzle-carrying assembly might have fewer nozzles than bottles (e.g., six nozzles to twelve bottles). But also, the nozzle-carrying assembly might have more nozzles than bottles.

Figure 13:
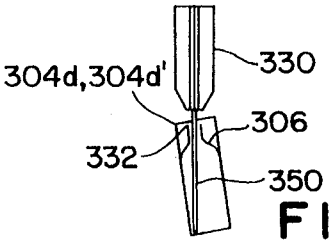
FIG. 13 is an elevation view similar to FIG. 12, except that the exemplary bottle is tilted to a draining position.
Figure 12:
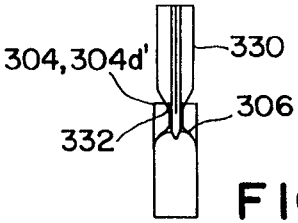
FIG. 12 is an enlarged elevation view of an exemplary bottle at the station of FIG. 11 where the bottles are cleaned, wherein the bottle is positioned upright in a flushing position.

As between a nozzle-carrying assembly having more nozzles than bottles arid another having less, it is to have more nozzles than bottles. In such a configuration, needless to say, there is a surplus of nozzles whenever an x-y field of bottles consists of fewer bottles than nozzles. The surplus nozzles move in unison with (but idly and harmlessly aside) the working nozzles. The surplus nozzles do not operate while the working nozzles do because each nozzle 330 has a valve (e.g., 135 in FIG. 4) that is actuated when displaced by a rim 332 of a bottle 306 (FIGS. 12 and 13). When a bottle and nozzle 330 are driven against each other, the rim 332 displaces the valve (e.g., 135 in FIG. 4), and in response the nozzle 330 operates. If no bottle, then no displacement of the valve occurs, and consequently nozzles such as the surplus nozzles do not operate. The valve (135 in FIG. 4) protects against the possibility of a void in the bottle array (e.g., missing bottle), safeguarding against inadvertent operation of a nozzle located in the field of working nozzles.

In FIG. 11, the twelve nozzles 330 are arranged in an x-y matrix (which corresponds to the x-y matrix of the twelve bottles 306 in each case 304). The nozzles 330 can be arranged in other specific positionings, such as a quincunx array (e.g., a nozzle at each corner of a square and another at the square's center, like the containers 22 in FIGS. 6 and 7). And there are other possible nozzle arrangements to which the teachings of the invention apply, preferably for bottles arranged in orderly, regular arrays conforming to some pattern or another.

At the retractable case stop 324, there is a case **304*d*. With reference to FIG. 15, a like case 304*d*′ is positioned in a like situation as case 304*d* in FIG. 11. Referring now to FIG. 15, the case 304*d*′ is gripped by retractable clamping members 334 (one shown) of the combined case-positioning and -tilting assembly 328. The operation of the clamping members 334 is coordinated with the arrival of the case 304*d* (FIG. 11) at the cleaning station 308 (FIG. 11), and is further coordinated with the cleaning operations to be described. Still in FIG. 15, the positioning/tilting assembly 328 comprises a pivot arm 336 having one end formed with upstanding forks 342 (one shown) carrying the clamping members 334, and an opposite end pivoted to a frame 438. The pivot end is coupled to the frame 438 via a pair of adjustable shafts 344 (one shown) for adjusting the x-position of the clamping members 334 relative to the stationary frame 438. The clamping members 334 and adjustable shafts 344 cooperatively position the case 304*d*′ in the x and y directions to align the bottles in the case in registry with the nozzles 330/360 overhead. The pivot arm 336 is operative clockwise in FIG. 15 such that it lifts the case 304*d*′ until the rims 332 abut the nozzles (see FIG. 12). The pivot arm 336 preferably can lift and lower the case 304*d*′ over a range of more than two vertical inches, because the bottle rims 332** typically lie two or so inches below the top edges of the case.

In FIG. 12, a bottle 306 and nozzle 330 are abutted for transferring cleaning fluid to the bottle 306. FIG. 13 shows the bottle 306 tilted relative to the nozzle 330 for transferring cleaning fluid back to the nozzle 330. For this, the nozzle 330 has an eductor tube 350 that can extend into the bottle 306 to vacuum out the cleaning fluid. Referring to FIGS. 12–13 and 15, the case positioning and tilting assembly 328 coordinates the tilting of the case 304*d'* with the vacuuming operation: As FIG. 15 shows, the clamping members 334 rotatably support the case relative to the forks 342, and an actuator (not shown) controls the rotation of the case. The operation of the eductor tubes 350 is coordinated with the tilting of the bottles. By these steps, all the bottles in the case 304*d'* are tilted in unison as the eductor tubes 350 extend down to vacuum out material, after which the eductors 350 retract. The case 304*d'* is reoriented upright, and lowered onto the flight conveyor 302. The clamping members 334 release the case 304*d'*. Referring back to FIG. 11, the case stop 324 retracts, and the case 304*d* advances down the conveyor flight to the filling station 310.

Staying in FIG. 11, a case 304*e* is temporarily stopped at the filling station 310 by another retractable case stop 352. The case 304*e* had there transferred onto driven rollers 354. Referring to both FIGS. 11 and 14, the filling station 310 comprises a frame 358 supporting a case-positioning assembly 362, the rollers 354, a set of case-lifting blades 356, and an overhead nozzle-carrying assembly 364 (FIG. 14) with nozzles 360 (FIG. 11). With particular reference to FIG. 14, the case-positioning assembly 362 incorporates the retractable case stop 352. This case stop 352 extends and retracts in the y-direction 332 via an actuator 366, thereby stopping and releasing cases advancing down the flight conveyor 302. The case stop 352 also moves in the x-direction 318 to provide a case-positioning function in the x-direction 318. This is achieved by how the case stop 352 is mounted.

The case-positioning assembly 362 includes a y direction stepper motor 368, a movable segment 372 of one of the opposite flight bars 314 (FIG. 15), and an x direction stepper motor 374 mounted on the movable segment 372. The movable segment is movable in the y direction 322. A yoke assembly 378 couples the case stop 352 to the x direction stepper motor 374. The yoke assembly 378 comprises a block 382 mounted on the movable segment 372, a pair of rods 384 slidable in holes in the block 382, and a nut 386 converting the turning of the x direction stepper motor 374 into linear movement of the slidable rods 384. A fixture (not shown) couples the slidable rods 384 to the case stop 352.

Operation of the x direction stepper motor 374 controls the x position of the case stop 352, and hence provides control over the x position of a case 304*e* (FIG. 11) temporarily held by the case stop 352. Operation of the y direction stepper motor 368 controls the y direction movement of the movable segment 372. If a case is stopped at the filling station 310, extension of the movable segment 372 away from the y direction stepper motor 368 results in the movable segment 372 driving against a side of the case 304*e* (FIG. 11). Further extension causes the movable segment 372 to drive the case 304*e* (FIG. 11) in the y direction against the opposite, stationary flight bar 314 (FIG. 11 ). Thus, operation of the y direction stepper motor 368 provides control over the positioning the case 304*e* (FIG. 11 ) in the y direction.

Returning to FIG. 11, after the case 304*e* is positioned in the desired x and y orientation, the case 304*e* is ready for lifting by the case-lifting assembly 388. The case-lifting assembly 388 comprises a case-lifting motor 392 mounted on the floor (e.g., in a stably fixed relationship with the frame 358). The case-lifting motor 392 turns a horizontal shaft 394 carrying a bevel gear 396 at its end, which turns a like bevel gear 398 at the lower end of a vertical shaft 402. The vertical shaft 402 extends through a nut 404 beneath a plate 406. The plate 406 is restrained from turning about the axis of the vertical shaft 402, but is permitted to extend and retract up and down. The plate 406 supports the bottom edges of the upstanding case-lifting blades 356.

The case-lifting blades 356 are placed between the rollers 354 which, for this purpose, are spaced apart and define gaps between themselves. The rollers 354 also define a case-carrying plane coplanar with the flight plane of the flight conveyor 302. The case-lifting blades 356 occupy positions in these gaps. The case-lifting blades 356 have a retracted position (e.g., FIG. 14) in which upper edges are retracted below the flight plane 302 to permit the case 304*e* to move onto and off of the driven rollers 354. The case-lifting blades 356 also have an extended position (FIG. 11) in which the case 304*e* is lifted so that the bottle rims 332 drive against the nozzles 360.

In use, the filling operation generally comprises the following sequence of events. A case advancing from the cleaning station 308 proceeds down the flight conveyor 302 until it moves onto the bed of rollers 354 and is then stopped against the case stop 352. The case-positioning assembly 362 positions the case 304*e* in proper x-y registry with the nozzles 360 overhead. The case-lifting assembly lifts the case 304*e* until the bottle rims 332 drive against the nozzles 360. This actuates the nozzle valves (e.g., 135 in FIG. 4), and the nozzles 360 then operate to supply material. The bottles 306 fill to a predetermined level, after which the nozzles 360 automatically shut off the supply of material. The case-lifting assembly 362 operates to lower the case 304*e* back to the bed of rollers 354. The case stop 352 retracts, the driven rollers 354 drive the case 304*e* in the downstream direction, and the case departs the filling station 310.

In FIG. 14, the nozzle-carrying assembly 364 is adjustable to change the relative positions of the nozzles 360 (FIG. 11). Adjustability is achieved in part by an x direction 'stepper motor 408 and a y direction stepper motor 410. The nozzle-carrying assembly 364 comprises two ranks of nozzle-carrying rods 412 and 414. One rank 412 comprises four horizontal rods extending parallel to one another in the y direction 322. The other rank 414 comprises three horizontal rods extending parallel to one another in the x direction 318 in a plane below said one rank 412. Said one rank 412 of four rods defines four rows as said other rank 414 of three rods defines three columns.

Each nozzle 360 (FIG. 11) is coupled to the rods 412 and 414 via a head assembly 416. Each head assembly 416 includes a block 418 bored twice through, one time resulting in a lower rod-accepting bore 422 extending in the x direction 318 and another time resulting in an upper rod-accepting bore 424 extending in the y direction 322. The two ranks of rods 412 and 414 are arranged such that the three column-defining rods extend transverse to the four row-defining rods. As a result, the two ranks of rods 412 and 414 (if viewed in plan from directly above) would define twelve intersections 420. The rods 412 and 414 are slidably coupled with the rod-accepting bores 422 and 424 of the twelve blocks 418 such that the twelve blocks 418 occupy positions at the twelve intersections 420, as shown. These positions 420 define a nozzle-position in an x-y field for each nozzle 360 (FIG. 11).

Preferably, each one of the four row-defining rods 412 has opposite ends drivable in tandem relative to the frame 358 in the x direction 318. Similarly, it is preferred that each one of the three column-defining rods 414 has opposite ends drivable in tandem relative to the frame in tandem in the y direction 322. In use, operation of the x direction stepper motor 408 changes the spacing among the four row-defining rods 412, just as operation of the y direction stepper 410 motor changes the spacing among the three column-defining rods 4 14. Thus selective operation of the x and/or y direction stepper motors 408 and 410 controls the relative spacing of rows and columns 412 and 414, respectively, of nozzles 360 (FIG. 11). This, as a result, operates the reconfiguring of the nozzles (new positions not shown) for a production run changeover to bottles of a different size and/or packing pattern.

FIG. 15 discloses structure according to the invention for converting the output of the x and y direction stepper motors (E.G., 408 and 410 in FIG. 14) into a change of spacing between parallel rods (e.g., 412 and 414 also in FIG. 14). It was previously disclosed (i.e., in reference to FIGS. 8–10) that this could be achieved by a combination of an externally-threaded shaft with a pantograph 202/206 that carries internally-threaded nuts at its joints 192. FIG. 15 discloses alternative structure for the previously disclosed threaded shaft and pantograph 202/206 of FIGS. 8–10. With particular reference to FIG. 15, the head-carrying assembly 364 has three ranks of rods 428,430, and 432. One rank 428 of rods (i.e., rank "one") consists of four row-defining rods associated with a clean-and fill station 310'. Another rank 430 of rods (rank "two") consists of another four row-defining rods Just two shown) associated with a capping station 312. A third rank 432 (rank "three") consists of three column-defining rods (just two shown) is oriented transverse to the first two ranks 428 and 430. Changing the spacing between the rods of any rank is achieved in part by use of linear drive nuts 426, 426', 426" of a pre-selected "pitch".

Linear drive nuts 426,426', 426" are known in the art and are advantageous because they are drivable by plain round drive-shafts 434 and 436 (i.e., without thread or other spiral features). Linear drive nuts 426, 426', 426" are commercially available, for example, from distributors of OEM Joachim Uhing KG GmbH & Co. "Pitch" refers to the extent of linear displacement of the nut in response to a revolution of the drive-shaft 434, 436 (i.e., travel per revolution). Pitch is also stated in terms of the diameter ("d") of the drive-shaft 434, 436. Pitch is important, needless to say, because linear drive nuts. 426 are selected according to a chosen pitch, such as, for example, chosen from among pitches of 0.1 d, 0.2 d, 0.3 d, 0.4 d and/or 0.5 d.

In FIG. 15, a frame 438 carries one pair of plain round drive-shafts 434 (one shown) extending parallel in the x direction 318 transverse to another pair 436 (one shown) extending in the y direction 322. The opposite drive-shafts 434 (one shown) carry between themselves the rods of ranks one and two 428 and 430. More particularly, the rods of rank one and two 428 and 430 extend between opposite drive nuts 426 and 426' respectively on the drive-shafts 434. Likewise, the other opposite drive-shafts 436 (one shown) carry between themselves the rods of rank three 432. And in this instance, the rods of rank three 432 extend between opposite drive nuts 426" on the drive-shafts 436. The rods of rank one 428 lie in a same horizontal plane as the rods of rank two 430. This common plane is spaced above a plane containing the rods of rank three 432. If viewed in plan from directly above, the three ranks of rods 428, 430, and 432 would define twenty-four intersections, a first twelve defined by rank one 428 across rank three 432 and the second twelve by rank two 430 across rank three 432. All the rods 428,430, and 432 cooperate to carry twenty-four sliding blocks 418, which blocks 418 occupy the twenty-four intersections. These intersections define two fields of twelve head-positions each, each field consisting of twelve head positions in a three-column by four-row matrix. The procedure for adjusting the head-positions in the y direction 322 comprises the following steps and components to change the parallel spacing among the rods of rank three 432. The y direction stepper motor (e.g., 410 in FIG. 14) operates to rotate the pair of plain round drive-shafts 436 simultaneously. The drive nuts 426" respond such that pairs of drive nuts 426" move in tandem to cooperatively move one rod of the three of rank three 432. The rods of rank three 432 move but remain parallel to one another, and parallel to the longitudinal axis 102 of the flight conveyor. The drive nuts 426" can be configured such that the rods of rank three 432 move according to predetermined schemes. For example, three pairs of drive nuts 426" can be chosen such that the nuts 426" of the respective pairs have pitches of 0.1 d, 0.2 d, and 0.4 d. The three pairs of nuts 426" are then matched with the three rods such that 0.1 d-pitch pair carry one of the two outer rods, the 0.2 d-pitch pair carry the middle rod, and the 0.4 d-pitch pair carry the other outer rod. For another example, the middle rod of rank three 432 can held in place by a pair stationary fixtures, one of the outer rods can be movably carried by a first pair of 0.3 d-pitch nuts 426", and the other outer rod can be movably carried a second pair 0.3 d-pitch nuts 426" that respond to clockwise rotation of the drive-shafts 436 by moving in a direction opposite to said first pair of 0.3 d-pitch nuts 426".

The operating principle of drive nuts 426, 426', 426" on plain round drive-shafts 434, 436 is known in the art and does not form a part of the invention. Briefly, a representative drive nut 426 has a housing carrying four ball bearings (not shown) adjacent one another. For sake of illustration, it is assumed that the representative drive nut 426 is carried by drive-shaft 434. The drive-shaft 434 is disposed extending through all four ball bearings. Each ball bearing has an outer and an inner race cooperatively defining a cage that retains a plurality of balls for rolling movement therein. Each inner race has an inner surface which is specially crowned with a convexity. The inner races are of a same inside diameter, which inside diameter is larger than the diameter of the drive-shaft 434. Thus, the inner races could be placed loosely on the drive-shaft 434. However, a middle set of two ball bearings is spring-biased vertically up (e.g., up in the z-direction) relative to the outer ball bearings. Consequently, the inner races of the middle two ball bearings grip the drive-shaft 434 at bottom-dead-center while the inner races of the outer two ball bearings grip the drive-shaft 434 at top-dead-center, and in opposition to the middle two.

The housing holds each of the outer races stationary at a fixed angle. This angle is the amount that the outer races deviate in a horizontal plane from a vertical plane extending in the y direction 322 (i.e., the vertical plane intersects the drive-shaft 434 perpendicularly). Pitch varies with this angle, wherein a smaller angle (e.g., the races are more nearly perpendicular to the drive-shaft 436) is equivalent to a smaller pitch. And so, the middle two ball bearings are parallel to each other at said angle, and the outer two ball bearings are parallel to each other and deviating from said vertical plane at said angle but in the opposite direction as the middle two ball bearings. In accordance with such structure, the drive nut 426 is displaced linearly along the plain round drive-shaft 434 as the drive-shaft 434 rotates (provided, needless to say, that the housing is restrained from rotating in unison with the drive-shaft 434). Drive nuts 426 also vary as being either right-handed or left-handed, corresponding to what direction the drive nut 426 advances in response to rotation of the drive-shaft 434. Right-handed drive nuts move as an equivalent right-threaded nut would move on a right-threaded shaft, and vice versa for left-handed drive nuts.

Returning to the adjustment of the head-positions, adjustment in the x direction 318 is achieved in much the same way as in the y direction 322. However, the combined eight rods of ranks one and two 428 and 430 need to be coupled to drive nuts 426 in accordance with different configurations than with the three rods of rank three 432. While more than one configuration is possible, an exemplary configuration comprises the following. Preliminarily, consider that rank one 428 and rank two 430 define an imaginary, vertical partition plane between themselves. With that in mind, the particular rod of rank one 428 furthest from the partition plane, like its counterpart in rank two 430, is held stationary by fixtures on the frame 438. The next rod of rank one 428 (e.g., third from the partition plane) is coupled to a tandem of right-handed 0.1 d-pitch nuts 426, as its counterpart in rank two 430 is coupled to a tandem of left-handed 0.1 d-pitch nuts 426'. The next rod after that in rank one 428 (second from the partition plane) is coupled to a tandem of right-handed 0.2 d-pitch nuts 426, as its counterpart in rank two 430 is coupled to a tandem of left-handed 0.2 d-pitch nuts 426'. And the remaining rod of rank one 428 (e.g., nearest the partition plane) is coupled to a tandem of right-handed 0.4 d-pitch nuts 426, as its counterpart in rank two 430 is coupled to a tandem of left-handed 0.4 d-pitch nuts 426'.

In operation, the x direction stepper motor (e.g., 408 in FIG. 14) turns the two plain round drive-shafts 434 that extend in the x direction 318 simultaneously. This changes the spacing between the four row-defining rods of the rank one 428 simultaneously with the four row-defining rods of rank two 430. More particularly, the outermost two of the eight rods of ranks one and two 428 and 430 remain in fixed positions. The inner three rods of rank one 428 advance and retreat telescopically in mirror opposite procession to the inner three rods of rank two 430. In this way, the spacing between the parallel rods of ranks one and two 428 and 430 are changed at the same time by operation of the one x direction stepper motor. Selective control of the x and y direction stepper motors (e.g., 408 and 410 in FIG. 14) consequently provides selective adjustment of the head positions of the twenty-four heads 364' in two x-y fields as desired.

To now turn to the bottling operations of FIG. 15, the common frame 438 supports the clean-and-fill station 310' aside the capping station 312. The clean-and-fill station 310' operates in the same fashion as previously described in reference to FIGS. 1–10. The capping station 312 coordinates with a cap dispensing system 444 the operations of picking, placing, and affixing caps (e.g., 442 in FIG. 18) to the rims 332 of the bottles. The cap-dispensing system 444 includes its own support stand 446 stably fixed relative to the frame 438. The support stand 446 straddles the flight conveyor 302 to slidably support a transfer plate 448 which can shuttle between opposite extremes.

Figure 16:
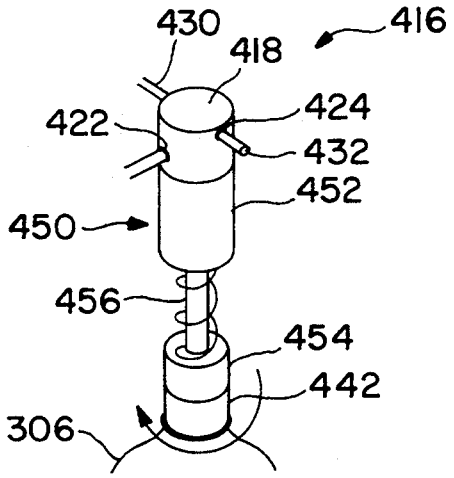
FIG. 16 is an enlarged perspective view of a head assembly of the capping station of FIG. 15.

In FIG. 16, a representative cap-affixing head 450 includes a block 418. Two transverse rods respectively of ranks 430 and 432 cooperatively carry the block 418 via rod-accepting bores 422 and 424. The block 418 semi-permanently carries a magnetic-clutch actuator 452 that releasably carries a cap-accepting gripping chuck 454. The gripping chuck 454 is capable of accepting a cap 442 of a single size, which size may be, for example, 18 mm in diameter. However, different gripping chucks can be releasably carried by the actuator 452 for gripping larger or smaller caps to correspond to the requirements of the bottle sizes of particular production runs. Whenever the bottling system 300 is changed to run bottles of a next-sized rim, then the previously-sized gripping chuck on the magnetic-clutch actuator 452 can be replaced with a properly-sized gripping chuck of the next-size. The magnetic-clutch actuator 452 is operable such that it extends and retracts a shank 456 affixed to the gripping chuck 454 (extended position shown in FIG. 16), while at the same time it turns the gripping chuck 454 (clockwise in FIG. 16).

Returning to FIG. 15, the transfer plate 448 is operative to shuttle laterally (i.e., in the y direction 322) between a cap take-on position (FIG. 15) and a cap pick-off position. The transfer plate 448 has an upper surface carrying twelve cap-accepting pegs 458 arranged to correspond to the array of the bottle centers (here, a 3×4 matrix). The cap-dispensing system 444 includes one or more (preferably more) cap hopper systems 462 (one shown) and twelve or so cap chutes 464 (one shown). Each cap chute 464 is flexible and extends between opposite ends, one end 466 being coupled to the cap hopper system 462 and the opposite end 468 being open. The open ends 468 of the cap chutes 464 are positioned (by support structure not shown) in a common horizontal plane above the pegs 458 on the transfer plate 448. Additionally, the open ends 468 are arranged in an x-y field corresponding to the x-y arrangement of the pegs 458 on the transfer plate 448. The cap-dispensing system 444 is equipped with sensors (not shown) for control of a selector (not shown) to ensure a supply of caps (e.g., 442 in FIG. 16) in each cap chute 464 and to synchronize the dispensing of a cap to a peg 458 when the transfer plate 448 is in the cap take-on position. For each case 304 of bottles, the transfer plate 448 shuttles once from the cap take-on position (e.g., FIG. 15) to the cap pick-off position, and back. The capping operation comprises the following sequence of events, where at the start the components begin in home positions, including (i) a case **304*f* temporarily stopped in the case-positioning assembly 470, (ii) the transfer plate 448 idling in the cap take-on position (with pegs 458 bare), and (iii) the magnetic-clutch actuators 452 operated to an extreme retracted position, all as shown in FIG. 15. So, at the start, the cap-dispensing system 444 operates to load one cap on each peg 458. Then, the transfer plate 448 is driven from the cap take-on position to the cap pick-off position, with each peg 458 carrying a cap. Next, the magnetic-clutch actuators 452 operate to extend the cap-accepting gripping chucks 454 down to pick-off the caps on the pegs 458. Following that, the actuators 452 operate to retract the gripping chucks 454, with caps in tow. The transfer plate 448 then returns to the cap take-on position, thereby permitting the gripping chucks 454 to have unobstructed passage to bottle rims 332 below. The actuators 452 operate once more, to extend the gripping chucks 454 down to place the caps 442 on the bottle rims 332. The turning action of the shank (e.g., 456 in FIG. 16) turns the gripping chucks 454 and so affixes the caps to the rims 332. The actuators 452 operate for a last time in the cycle, and the gripping chucks 454 retract back to their extreme retracted positions. The case stop (e.g., 472 in FIG. 11) retracts, the case 304***f* exits, and a next case 304*d* advances to the capping station 312 for case-positioning, after which the above-sequence of events repeats.

The cap-dispensing system 444 can operate during the cap-affixing operation and/or the case-positioning operation. The actuators 452 have strokes sufficient to both retract above the cap-carrying pegs 458 on the transfer plate 448 and extend down to rims 332 located two inches below the top edges of the case 304*f*. Consequently, it is preferable that the actuators 452 have strokes of a couple to several inches or so. It is also preferable that the bottom of the cases be specially prepared for the capping operation. More specifically, the bottom of the cases, while empty, are preferably coated with a high friction varnish (not shown). The bottles then would be packed in the cases on top of the high friction varnish. The high friction varnish will better resist rotation of the bottles 306 when they are coupled to the turning cap-accepting gripping chucks 454.

Figure 17:
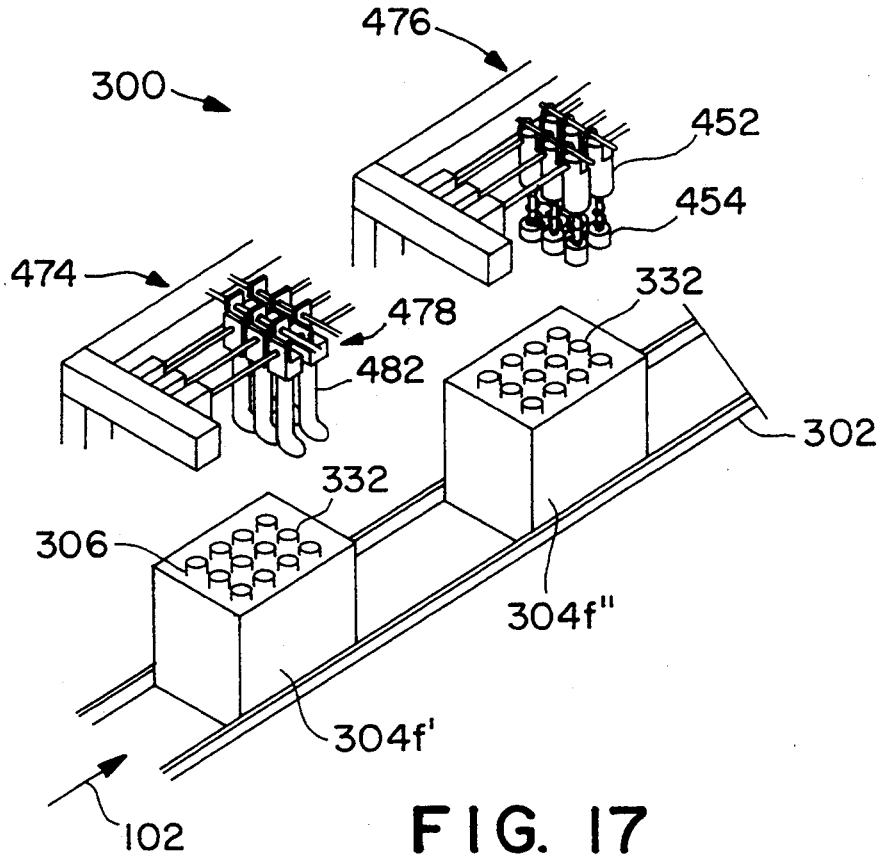
FIG. 17 is a schematic perspective view of another embodiment of the invention, wherein two stations cooperatively perform the capping operation, one which performs cap-dispensing operations and another performing cap-affixing operations.
Figure 18:
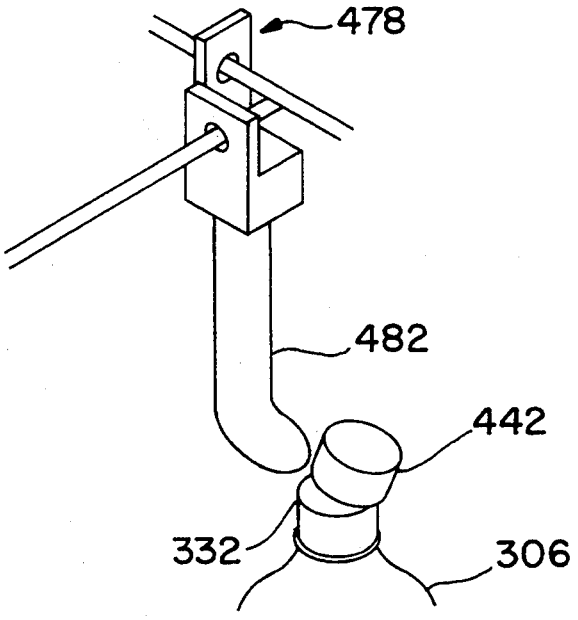
FIG. 18 is an enlarged perspective view of a head assembly in FIG. 17 of the cap-dispensing station.

FIGS. 17 and 18 show an alternative embodiment of a capping operation. The alternative embodiment coordinates a cap-dispensing station 474 with a cap-affixing station 476. The cap-dispensing station 474 comprises a 3 column by 4 row matrix (2×3 shown) of twelve heads 478 carrying chute-carrying fixtures 482 for cap chutes (not shown). Each fixture 482 positions a lower open end of a cap chute for dispensing and placing caps on bottle rims 332 in a coordinated manner. The cap chutes are combined with a cap hopper (not shown), wherein the cap hopper and chutes of FIGS. 17 and 18 (not shown) operate generally the same as the illustrated cap hopper and chutes 462 and 464 of FIG. 15. Thus, the cap chute of each chute-carrying fixture 482 includes a selector, which selector ensures a supply of caps in the chute and dispenses and loads one cap on one bottle rim 332 in synchronization with the bottles 306 being positioned in registry with the chute-carrying fixtures 482.

A case 304*f'* at this cap-dispensing station 476 in time departs and advances on to the cap-affixing station 476. The case 304*f''* is temporarily held and positioned by the case-positioning assembly (e.g., 470 in FIG. 15) so that the rims 332, which would then be carrying caps (not shown) loosely, are more accurately aligned in registry with the cap-accepting gripping chucks 454. The magnetic-clutch actuators 452 extend and retract once per case. In use, the actuators 452 operate to extend the cap-accepting gripping chucks 454 down against the caps which are carried loosely on the rims 332. The turning action of the chucks 454 then affixes the caps to the rims 332. Next, the cap-accepting gripping chucks 454 return to their retracted positions. Finally, the case departs down the flight conveyor 302.

The foregoing examples are discussed using terms such as rows, columns, longitudinal, lateral, etc. It will be appreciated that the containers or bottles need not be aligned in any particular orientation relative to the direction 102 of conveyor advance, provided they are positioned at predetermined positions in registry with the head assemblies above.

The invention having been disclosed in connection with certain preferred embodiments as examples, variations within the scope of the invention will now be apparent to persons skilled in the art. The invention is not intended to be limited to the preferred examples. Accordingly, reference should be made to the appended claims rather than the foregoing embodiments to assess the scope of exclusive rights in the invention claimed.

I claim:

1. Apparatus for processing arrays of equally sized containers through a container-processing operation, said apparatus being adjustable to process at least two different sized containers and having a longitudinal axis defining an x direction and a lateral axis perpendicular thereto defining a y direction, the containers of each of the different sizes being arranged in regular x-y arrays such that the containers have centers defining a regular array wherein the centers coincide with intersections between parallel longitudinal axes and parallel lateral axes; the apparatus comprising:

container-supporting means for supporting a set of containers in an upright orientation wherein the containers of said set occupy a plurality container positions on at least two adjacent ones of the plurality of lateral axes, the centers of laterally adjacent containers being evenly spaced apart;

a plurality of heads movably mounted on a support structure, the plurality of heads including a set of heads for occupying head positions in registry with each of the container positions of said set of containers; the heads being operatively coupled to a given container-processing system; and, adjustable means on the support structure, operable to displace at least a subset of the heads along the longitudinal axes and along the lateral axes perpendicular to the longitudinal axis, thereby being operable to alter the head positions for achieving at least two alternative spacings of the heads corresponding to the centers of the containers of said at least two different sizes.

2. Apparatus according to claim 1 wherein the container-processing system comprises at least two of a container-cleaning system, a container-filling system associated with a source of material, a closure-dispensing system associated with a source of closures, and a closure-affixing system, and wherein said at least two to correspond to at least two operations chosen from a cleaning operation, a filling operation, a closure-dispensing operation, and a closure-affixing operation, respectively.

3. Apparatus according to claim 1 wherein the container-supporting means supports sets of containers such that the containers of each set define one of a quincunx array and a regular-matrix array.

4. Apparatus according to claim 1 wherein the container-supporting means supports sets of containers such that the containers of each set define at least three lateral axes evenly spaced apart from one another.

5. Apparatus according to claim 1 wherein the container-supporting means supports sets of containers such that each set is disposed in a same-sized packaging case.

6. Apparatus according to claim 1, wherein the adjustable means is motorized.

7. Apparatus according to claim 1, wherein the adjustable means comprises a driven plain round shaft cooperating with linear drive nuts that are linearly displaced by rotation of the plain round shaft.

8. Apparatus according to claim 1, wherein the support structure includes a base support defining a flight plane of the containers and a vertically movable support, and drive means operable to raise and lower said support for raising and lowering the containers relative to the heads.

9. Apparatus according to claim 1, wherein the given system is a cleaning system, the apparatus further comprising nozzles carried by the heads, a pressure source and a suction source coupled to the nozzles, said pressure source and suction source being arranged for at least one of flushing the containers for cleaning and suctioning the containers for removing foreign particles.

10. Apparatus according to claim 1, wherein the given system is a filling system, the apparatus further comprising nozzles carried by the heads, and a pressure source coupled to the nozzles, said pressure source being arranged for supplying material from the material source into the containers.

11. Apparatus according to claim 1, wherein the given system is a cleaning-and-filling system combined.

12. Apparatus according to claim 1, wherein the given system is a filling system, the apparatus further comprising nozzles carried by the heads, and a pressure source and a suction source coupled to the nozzles, said pressure source and suction source being arranged for at least one of forcing material from the material source into the containers and suctioning from the containers air displaced by the material discharged into the containers.

13. Apparatus according to claim 12, wherein the pressure and suction sources are coupled to the nozzles and to the source of material for simultaneously (a) forcing the material from the material source into the containers and (b) suctioning from the containers the air displaced by the material discharged into the containers.

14. Apparatus according to claim 1, wherein the given system is a closure-dispensing system, the apparatus further comprising chute-carrying fixtures coupled to the heads for carrying chutes inside which a supply of closures can be transferred from a closure source to the open tops of the containers.

15. Apparatus according to claim 1, wherein the given system is a closure-affixing system, the apparatus further comprising closure-accepting chucks coupled to the heads, the chucks being operative to affix closures tightly that were being carried loosely on the open tops of the containers.

16. Apparatus according to claim 1, wherein the given system is a closure-dispensing system and closure-affixing combined, the apparatus further comprising closure-accepting chucks coupled to the heads, and a closure-carrying transfer plate positionable in one position between the chucks and the open tops of the containers and another position permitting engagement between the chuck and the open tops of the containers, the transfer plate being supplied closures by a dispensing system, the chucks and transfer plate being coordinated for transferring closures from the transfer plate to the chucks, the chucks being operative to affix the transferred closures onto the containers.

* * * * *